United States Patent [19]

Miyamoto

[11] 3,952,117

[45] Apr. 20, 1976

[54] METHOD OF DESENSITIZING

[75] Inventor: Akio Miyamoto, Fujimiya, Japan

[73] Assignee: Fuji Photo Film Co., Ltd., Minami-ashigara, Japan

[22] Filed: Aug. 8, 1974

[21] Appl. No.: 495,748

[30] Foreign Application Priority Data

Aug. 8, 1973 Japan ..... 48-88984

[52] U.S. Cl. ..... 427/150; 427/146; 427/151; 427/261

[51] Int. Cl.[2] ..... B41M 3/12

[58] Field of Search ..... 117/36.2, 36.4, 36.8; 427/261, 146, 150, 151, 152

[56] References Cited

UNITED STATES PATENTS

| | | | |
|---|---|---|---|
| 2,777,780 | 1/1957 | Cormack et al. | 117/36.4 |
| 3,364,052 | 1/1968 | Martino | 117/36.2 |
| 3,852,094 | 12/1974 | Yarian | 117/36.2 |

*Primary Examiner*—J. Travis Brown
*Attorney, Agent, or Firm*—Sughrue, Rothwell, Mion, Zinn & Macpeak

[57] ABSTRACT

A method of desensitizing a color developer used in a color forming reaction with a color former comprising contacting a desensitizer composition containing polypropylene glycol having an average molecular weight of about 400 to 5000 with the color developer.

6 Claims, No Drawings

METHOD OF DESENSITIZING

BACKGROUND OF THE INVENTION

1. Field of the Invention

The present invention relates to a method of desensitizing a color developer to be used with a color former employing a desensitizer composition. More particularly, the present invention relates to a method of desensitizing using a desensitizer composition which reduces or extinguishes the function of the developer (solid electron accepting compound) for developing the color former (substantially colorless electron donor organic compound).

2. Description of the Prior Art

It is well known that a developed color image can be obtained by contacting a color former with a developer. This phenomenon is utilized in pressure sensitive copying papers (see U.S. Pat. Nos. 2,505,470, 2,505,489, 2,550,471, 2,548,366, 2,712,507, 2,730,456, 2,730,457, and 3,418,250, etc.), and heat sensitive recording papers (see Japanese Patent Publication No. 4160/1968 and U.S. Pat. No. 2,939,009, etc.), etc. Furthermore, a printing method in which a developed color image is obtained by supplying a color former containing ink through a screen such as a stencil to a developer coated sheet, is known (see German Patent Laid Open No. 1,939,962).

A pressure sensitive copying paper is produced by dissolving the color former in a solvent such as chlorinated paraffin, alkyl naphthalene, alkylated diphenylethane, and alkylated diphenylmethane; dispersing the resulting solution in a binder or microencapsulating the solution; and then coating the dispersion on a support such as paper and plastic film, etc.; and, on the other hand, coating an acid clay, a phenol-formaldehyde resin, metal salts of aromatic carboxylic acids, etc., as the developer. A heat sensitive recording paper is produced by coating the color former and developer together with a heat meltable material such as acetanilide on a support. In this case, the heat meltable material melts on heating and dissolves the color former.

In general, the color former and the developer are coated on the same side or opposite sides of the support or on different supports. Thus, it is necessary that the color forming reaction is prevented from occuring at portions where the formation of the developed color image is not needed or should be inhibited. For this purpose, a desensitizer has been conventionally partially coated on the developer coated layer, thereby preventing the color forming reaction.

As the desensitizer, high molecular weight primary alkylamines such as dodecyl amine, and quaternary ammonium salts such as dodecyl trimethyl ammonium chloride, as described in U.S. Pat. No. 2,777,780; tertiary amines prepared from ethylene oxide and a monoalkylamine, an aralkylamine, or an ethanolamine, as described in Japanese Patent Publication No. 29546/1971; secondary alkylamines, such as didodecylamine; tertiary amines, such as triethylamine; primary arylamines, such as aniline; and aralkylamines, such as benzylamine; etc. are known.

These desensitizers, however, have drawbacks and more excellent desensitizers with better properties have been desired. For instance, since a desensitizer having a high desensitizing effect is water-soluble and of very high hygroscopicity, when it is used as a desensitizing ink, the ink absorbs moisture, particularly at high humidity, thereby separating a binder and thus the viscosity of the ink is insufficient and coating of the ink cannot be carried out smoothly. Moreover, when the desensitizer is allowed to stand together with microcapsules, the water absorbed in the desensitizer swells the wall of the microcapsule and in some cases, breaks the wall. Unpleasant odor, coloring of the coated surface, the discoloration of printing with the color ink are also disadvantages of the prior art desensitizers.

SUMMARY OF THE INVENTION

An object of the present invention is to provide a method of desensitizing using a non-hygroscopic desensitizer.

Another object of the present invention is to provide a method of desensitizing using a desensitizer which does not swell or break the wall of the microcapsule.

Another object of the present invention is to provide a method of desensitizing using a colorless, odorless, and harmless desensitizer.

Another object of the present invention is to provide a method of desensitizing using a desensitizer which does not discolor or fade the printing with a color ink.

Another object of the present invention is to provide a method of desensitizing using a desensitizer composition as described above.

The above mentioned objects can be attained by contacting a color developer for a color former with a desensitizer composition containing polypropylene glycol having an average molecular weight of about 400 to 5000 as the desensitizer.

DETAILED DESCRIPTION OF THE INVENTION

Polypropylene glycol is a well known compound and the desired molecular weight can be obtained by adding the requisite amount of propylene oxide to propylene glycol.

It will become apparent from the following description that the molecular weight of polypropylene glycol within the above range is significant in the present invention.

The most important property required for the desensitizer is a high desensitizing effect, i.e., to the extent that the developing capability of the developer is reduced or extinguished.

Polypropylene glycol having a molecular weight below about 7,000 possesses an extremely excellent desensitizing effect. However, solubility, hygroscopicity, viscosity, etc. greatly vary within the above mentioned range of molecular weight.

The solubility of the polypropylene glycol in water increases as the molecular weight thereof decreases. For instance, a polypropylene glycol having a molecular weight below about 300 completely dissolves in water. When the molecular weight is about 700, about 1200, and above about 2000, the solubility is 5.0, 2.0, and below 0.1 grams per 100 grams of water, respectively. By increasing the molecular weight, the hygroscopicity is reduced and when the molecular weight is above about 400, the polypropylene glycol is non-hygroscopic. However, when the molecular weight is above 5000, the viscosity becomes too high, thereby resulting in a reduction of the rate of absorption in the coated surface (developer layer). A polypropylene glycol having a molecular weight of about 400 to 5000 is a liquid whose melting point is extremely low and whose viscosity is not affected by variations in temperature.

Thus, polypropylene glycol having a molecular weight of about 400 to 5000, preferably about 1000 to 3000, is useful and is distinguishable over the polyethylene glycol as described in Japanese Patent Publication No. 22651/1971; the propylene glycol and the dipropylene glycol as described in Japanese Patent Publication Nos. 21448/1970 and 22651/1971; and a block copolymer of polyoxyethylene and polypropylene as described in Japanese Patent Publication No. 38201/1972, etc.

The desensitizer composition of the present invention means a composition which contains the above mentioned polypropylene glycol as a desensitizing component and, if desired, along with various additives. Thus, the amount of the polypropylene glycol to be added can be varied widely and it can comprise about 5 to 60% by weight, preferably about 20 to 50% by weight, of the composition. The upper limit is determined only by economic reasons.

Other ingredients which can be included in the desensitizer composition of the present invention are the same as those used in prior art desensitizer compositions, such as natural or synthetic polymer compounds, e.g., a ketone resin, a polyamide resin, a maleic acid resin, a phenol resin, an epoxy resin, an alkyd resin, a melamine resin, a urea resin, nitrocellulose, ethylcellulose, a butyral resin, polyvinyl alcohol, gelatin, and shellac, which are in most cases used as a binder although not limited thereto; pigments, e.g., titanium oxide, zinc oxide, barium sulfate, magnesium carbonate, potassium carbonate, barium carbonate, magnesium hydroxide, and talc, which improve printing property, whiteness, and covering capability; organic solvents; fats, e.g., paraffin and phorone; vegetable oils, e.g., linseed oil, soybean oil, cotton seed oil, and the like; offset-preventing agents such as starch; and other desensitizers; etc. Particularly, mixtures of the compounds of the present invention and polyoxyethylene alkylamines are preferred in that the desensitizing effect is high and the hydroscopicity is low.

The composition of the present invention can be employed in various forms as an organic solution such as an alcohol solution, an aqueous dispersion, a paste, and a solid, etc. It is to be noted that the function of the above described composition is not lost due to the kind, amount, or form of the other indredients.

The desensitizer composition is applied to the developer using methods such as printing, e.g., anastic or gravure printing, spraying, handwriting with a crayon or an eraser, etc. The amount of the desensitizer composition which is sufficient is that amount such that the desensitizer ranges from about 0.7 to 8 g/m$^2$ and preferably about 2 to 5 g/m$^2$.

The developers to which the desensitizer of the present invention can be applied, are electron acceptor compounds, which are known in the art. Representative examples are clay minerals such as acid clay, activated clay, attapulgite and the like; organic acids such as tannic acid, gallic acid, the propylester of gallic acid, and the like; acidic polymers such as phenolformaldehyde resins, phenol-acetylene resins, and the like; metal salts of aromatic carboxylic acids such as zinc salicylate, stannous salicylate, zinc 2-hydroxynaphthenate, zinc 3,5-di-tertbutyl salicylate, and the like; and mixtures thereof. The developer is coated, e.g., in an amount of about 1 to 10 g/m$^2$, preferably 2 to 7 g/mhu 2, on a support such as paper, or a plastic film laminated paper, together with a binder such as a styrene butadiene latex. These developers are disclosed in U.S. Pat. Nos. 2,711,375; 2,712,507; 2,730,456; 2,777,780; 2,800,457; 3,293,060; 3,427,180; 3,455,721; 3,466,185; 3,516,845; 3,634,121 and 3,672,935; U.S. patent application Ser. Nos. 184,608, filed Sept. 28, 1971; 183,647, filed Sept. 24, 1971; 192,593, filed Oct. 26, 1971 and 192,594, filed Oct. 26, 1971.

The color formers are substantially colorless and electron donor organic compounds. Triarylmethane dyes, diphenylmethane dyes, xanthene dyes, thiazine dyes, spiropyran dyes, and the like can be used. The triarylmethane dyes include 3,3-bis(p-dimethylaminophenyl)-6-dimethylaminophthalide, i.e., Crystal Violet Lactone (hereinafter referred to as CVL), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis-(2-phenylindole-3-yl)-5-dimethylaminophthalide, 3-p-dimethylaminophenyl-3-(1-methylpyrrole-2-yl)-6-dimethylaminophthalide, and the like; the diphenylmethane dyes include 4,4'-bis-dimethylaminobenzhydoline benzyl ether, N-halophenylleucoauramine, N-2,4,5-trichlorophenylleucoauramine, and the like; the xanthene dyes include Rhodamine B-anilino lactam, Rhodamine(p-nitroanilino)lactam, Rhodamine B (p-chloranilino)lactam, 7-dimethylamino-2-methoxyflouran, 7-diethylamino-2-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)fluoran, 3,7-diethylaminofluoran, 7-diethylamino-3-(benzylamino)fluoran, 7-diethylamino-3-(methylbenzylamino)fluoran, 7-diethylamino-3-(chloromethylamino)fluoran, 7-diethylamino-3-(diethylamino)fluoran, and the like; the thiazine dyes include benzoyl leuco Methylene Blue, p-nitrobenzyl leuco Methylene Blue, and the like; and the spiro dyes include 3-methyl-spiro-dinaphtho pyran, 3-ethyl-spiro-dinaphtho pyran, 3,3'-dichloro-spiro-dinaphtho pyran, 3-benzylspyro-dinaphthyopyran, 3-methyl-naphtho-(3-methoxy-benzo)spiro pyran, 3-propyl-spiro-dibenzo pyran, and the like.

The color former is dissolved in a synthetic or natural oil such as chlorinated diphenyl, chlorinated terphenyl, alkylated diphenyl, alkylated terphenyl, chlorinated paraffin, chlorinated naphthalene, alkylated naphthalene, kerosene, paraffin, and naphthene oil, etc., and coated on a support along with a binder, or it is encapsulated using the method as described in U.S. Pat. No. 2,800,457 and coated on a support, if desired, with additives such as an anti-smudge agent, e.g., starch particles. Alternatively, a solution of the color former can be coated only on the requisite portion. The color former and the developer can be in any condition suitable for the pressure sensitive recording member, heat sensitive copying paper, and other various applications.

The present invention will be further illustrated by reference to the following examples. The developer sheet, the color former sheet, and the desensitizing ink in the examples were produced in the following manner. Unless otherwise indicated all parts are by weight.

PREPARATION OF DEVELOPER SHEET A 100 parts of a sulfuric acid treated acid clay was dispersed in 280 parts of water containing 10 parts of a 20% sodium hydroxide solution with a homogenizer. To the resulting dispersion were added 10 parts of a 10% aqueous solution of methyl vinyl ether-maleic anhydride copolymer sodium salt and 37 parts of styrene butadiene latex, which was coated on a paper of a weight 50 g/m² using air-knife coating to provide a solids content of 10 g/m² and dried to thereby obtain a developer sheet.

PREPARATION OF DEVELOPER SHEET B 170 parts of para-phenylphenol, 70 parts of a 37% formaldehyde aqueous solution, and 50 parts of water were condensed at 160°C in the presence of a concentrated hydrochloric acid catalyst and then cooled to thereby produce a phenol resin powder.

50 parts of the phenol resin as prepared above, 10 parts of polyvinyl alcohol, and 500 parts of water were admixed in a ball mill for 10 hours to thereby obtain a coating liquid (Coating Liquid B).

The resulting coating liquid was coated on a paper of 50 g/m² in a solids content of 2 g/m² and dried to thereby obtain Developer Sheet B.

PREPARATION OF DEVELOPER SHEET C 4 parts of sodium hydroxide was dissolved in 200 parts of water, in which 25 parts of 3,5-di-tert-butylsalicylic acid was dissolved with stirring.

To the resulting solution, a solution prepared by dissolving 7 parts of zinc chloride in 100 parts of water was gradually added with stirring, and then 50 parts of a 10% polyvinyl alcohol aqueous solution was added. The resulting solution was mixed in a ball mill for 10 hours to thereby obtain Coating Liquid C.

Coating Liquid C was coated on paper of 50 g/m² in a solids content of 2 g/m² and dried to thereby produce Developer Sheet C.

PREPARATION OF DEVELOPER SHEET D 35 parts of Coating Liquid B, 50 parts of Coating Liquid C, and 15 parts of agalmatolite clay were mixed in a ball mill for 10 hours to thereby produce a coating liquid. The coating liquid was coated on a paper of 50 g/m² in a solids content of 2 g/m² and dried to thereby obtain Developer Sheet D.

PREPARATION OF COLOR FORMER SHEET A 10 parts of acid treated gelatin having an isoelectric point of 8.0 and 10 parts of gum arabic were dissolved in 60 parts of water at 40°C and 0.2 parts of sodium alkylbenzene sulfonate was added as an emulsifying agent. In the resulting solution, 50 parts of a color former oil was emulsified. The color former oil was prepared by dissolving 2.5 parts of Crystal Violet and 2.0 parts of benzoyl leuco methylene blue in an oil consisting of 4 parts of diisopropyl biphenyl and 1 part of kerosene.

When the average droplet size reached about 8 microns, the emulsifying reaction was stopped by adding 100 parts of water at 40°C.

While continuing the stirring, 210 parts of water at 30°C was added and then a 20% hydrochloric acid solution was added to adjust the pH of the system to 4.4. The solution was cooled to 8°C with stirring and then 1.5 parts of 20% glutaronitrile was added.

30 parts of a 10% carboxymethyl starch solution was added and then the pH of the system was adjusted to 8.5 by adding a 25% sodium hydroxide solution. When the temperature of the liquid was heated to 30°C, microcapusles having cured walls were obtained.

10 parts of cellulose flock was dispersed in the liquid and the resulting solution was coated on a paper of 40 g/m² in a solids content of 6 g/m². Thus, Color Former Sheet A was obtained.

PREPARATION OF COLOR FORMER SHEET B

1% by weight of Crystal Violet lactone, 4% by weight of 3-diethylamino-7-diethylaminofluoran, 4% by weight of 3-diethylamino-7-phenylaminofluoran, 3% by weight of 3-diethylamino-7,8-benzofluoran, 0.5% by weight of 3,6-bimethoxy-fluoran, and 2% by weight of benzoyl leuco methylene blue were dissolved in an oil consisting of 1 part of diisopropylnaphthalene, 1 part of diisopropylbiphenyl, and 2 parts of 1-(dimethylphenyl)-1-phenylethane to thereby produce a color former oil.

The same procedure as set forth in Color Former Sheet A was conducted using 50 parts of the above color former oil and Color Former Sheet B was obtained.

PREPARATION OF DESENSITIZING INK 25 parts of linseed oil modified alkyd resin and 75 parts of titanium oxide were kneaded uniformly in a three roll mill to thereby form a base ink.

4 parts of the base ink and 1 part of the desensitizers as shown in the Table below were uniformly admixed in a three roll mill to thereby produce desensitizing inks.

Test Method

A. The Desensitizing Ink was print-coated on each of the Developer Sheets in an amount of 5.0 g/m². The thus desensitized area of the sample was superposed on the color former sheet and pressed at the pressure of 600 Kg/cm² to thereby effect color formation. After irradiating the samples with ultraviolet light for 20 minutes with a Fade-o-meter, the sample was allowed to stand in a dark place for one day and night. The value of the density was measured with a Densitometer. The desensitizing effect was determined from the reflection visible density value (Vis. D) as obtained above.

B. 5 g of each of the Desensitizing Inks was placed in a laboratory dish and allowed to stand under the conditions of a temperature of 50°C and 95% relative humidity for 5 hours. The amount of moisture absorbed was compared.

C. Papers prepared by coating 5.0 g/m² of each of the Desensitizing Inks (sheets prepared in the same manner as in (A)) were written on with ball-point pens and fountain pens in red, blue and black colors, and the blotting of color ink, and the discoloration and color fading were compared.

Table

| Example No. | Desensitizer | Desensitizing Effect (vis.D) Color Former Sheet A: Developer Sheet A | Developer Sheet B | Developer Sheet C | Developer Sheet D | Color Former Sheet B Developer Sheet A | Amount of Water Absorbed (%) | Staining of Color Ink | Discoloration and Fading of Color Ink |
|---|---|---|---|---|---|---|---|---|---|
| 1 | Polypropylene glycol (molecular) weight 400) | 0.05 | 0.05 | 0.05 | 0.05 | 0.08 | 0.87 | O | O |
| 2 | " (molecular) weight 1000) | 0.05 | 0.05 | 0.05 | 0.05 | 0.08 | 0.02 | O | O |
| 3 | " (molecular weight 3000) | 0.05 | 0.05 | 0.05 | 0.05 | 0.08 | 0.01 | O | O |
| 4 | " (molecular weight 5000) | 0.06 | 0.05 | 0.05 | 0.05 | 0.08 | 0.01 | O | O |
| 5 | Mixture of 3 parts of polypropylene glycol (molecular weight 1000) and 1 part of $C_{18}H_{37}N\langle^{(CH_2CH_2O)_xH}_{(CH_2CH_2O)_yH}$ (x+y=10) | 0.05 | 0.05 | 0.05 | 0.05 | 0.08 | 1.91 | O | O |
| 1 | Polyethylene glycol (molecular weight 400) | 0.06 | 0.07 | 0.07 | 0.08 | 0.21 | 9.20 | Δ | O |
| 2 | Propylene glycol | 0.09 | 0.13 | 0.11 | 0.12 | 0.45 | 8.46 | Δ | O |
| 3 | $C_{18}H_{37}N\langle^{(CH_2CH_2O)_xH}_{(CH_2CH_2O)_yH}$ (x+y=10) | 0.05 | 0.06 | 0.07 | 0.07 | 0.09 | 7.50 | X | X |
| 4 | Polypropylene glycol (molecular weight 6000 | 0.07 | 0.07 | 0.06 | 0.06 | 0.10 | 0.01 | O | O |
| 5 | " (molecular weight 300) | 0.05 | 0.05 | 0.05 | 0.05 | 0.08 | 3.10 | Δ | O |
| 6 | $HO-(C_2H_4O)_m-(C_3H_6O)_p-(C_2H_4O)_n-H$ m+n=30 p=35 | 0.06 | 0.07 | 0.07 | 0.07 | 0.10 | 5.31 | Δ | O |

O Commerciabilly usable
Δ Usable, but difficult to be commercially used
X Not commercially usable The usefulness of the compounds of the present invention is apparent from the results in the table. That is, since the value of the desensitizing effect (vis. D) is less, the desensitizing effect is large. The value below 0.08 shows a complete desensitization. Thus, the complete desensitization is attained by the compounds of the present invention.

In the Comparison Examples, the amount of water absorbed is more than 7.5%. When the value is more than 4%, the binder in the desensitizing ink separates at high humidity due to the hygroscopicity and thus the viscosity becomes insufficient and the coating is wrinkled. Moreover, the wall of the microcapsules containing the color former is damaged by the water absorbed. On the contrary, when the compounds of the present invention are used, the value is below 2% and thus they are quite stable at high humidity.

Thus, in view of the distinction in the staining of the color image and the discoloration and fading of the color ink, it can be seen that the effect of the present invention is excellent.

While the invention has been described in detail and with reference to specific embodiments thereof, it will be apparent to one skilled in the art that various changes and modifications can be made therein without departing from the spirit and scope thereof.

What is claimed is:

1. A method for desensitizing an electron accepting color developer compound used with a substantially colorless electron donor organic color former compound to produce a color forming reaction in a pressure-sensitive or heat-sensitive transfer system comprising contacting said color developer with a desensitizer comprising polypropylene glycol having an average molecular weight of from about 400 to 5,000.

2. The method of claim 1, wherein said polypropylene glycol has an average molecular weight of about 1000 to 3000.

3. The method in claim 1, wherein the desensitizer composition comprises a binder, polypropylene glycol having an average molecular weight of about 400 to 5000, and at least one of a pigment and an organic solvent.

4. The method of claim 3, wherein the polypropylene glycol comprises about 5 to 60% by weight of the desensitizer composition.

5. The method of claim 3, wherein the desensitizer composition includes a polyoxyethylene alkylamine.

6. The method of claim 1, wherein the color developer is coated on a support and said contacting is by applying said desensitizer composition to said color developer on said support.

* * * * *